US005744748A

United States Patent [19]

Mikhail

[11] Patent Number: 5,744,748

[45] Date of Patent: Apr. 28, 1998

[54] KINETIC ENERGY PROJECTILE WITH FIN LEADING EDGE PROTECTION MECHANISMS

[75] Inventor: Ameer G. Mikhail, Bel Air, Md.

[73] Assignee: The United States of America as represented by the Secretary of the Army, Washington, D.C.

[21] Appl. No.: 840,120

[22] Filed: Apr. 14, 1997

Related U.S. Application Data

[62] Division of Ser. No. 716,678, Sep. 13, 1996, Pat. No. 5,668,347.

[51] Int. Cl.[6] ..... F42B 14/00; F42B 10/00; B64C 1/10

[52] U.S. Cl. ..... 102/523; 102/520; 244/3.24; 244/3.28; 244/3.3; 244/121

[58] Field of Search ..... 244/3.24, 3.25, 244/3.26, 3.27, 3.28, 3.29, 3.3, 121, 117 A, 158 A; 102/520, 521, 522, 523

[56] References Cited

U.S. PATENT DOCUMENTS

| | | | |
|---|---|---|---|
| 3,765,620 | 10/1973 | Donner et al. | 244/3.24 |
| 4,242,960 | 1/1981 | Boeder et al. | 102/529 |
| 4,318,344 | 3/1982 | Price et al. | 102/520 |
| 4,434,718 | 3/1984 | Kopsch et al. | 102/522 |
| 4,607,810 | 8/1986 | Frazer | 244/3.29 |
| 4,936,219 | 6/1990 | Mudd | 102/520 |
| 4,978,088 | 12/1990 | Himmert et al. | 244/3.24 |
| 5,040,746 | 8/1991 | Mikhail | 244/3.27 |
| 5,062,585 | 11/1991 | Mikhail | 244/3.24 |
| 5,112,008 | 5/1992 | Pahnke et al. | 244/3.24 |
| 5,474,256 | 12/1995 | Garner | 244/3.24 |
| 5,493,974 | 2/1996 | Bilgeri | 102/52 |
| 5,589,658 | 12/1996 | Sauvestre | 102/521 |
| 5,668,347 | 9/1997 | Mikhail | 102/523 |

*Primary Examiner*—Charles T. Jordan
*Assistant Examiner*—Theresa M. Wesson
*Attorney, Agent, or Firm*—Paul S. Clohan

[57] ABSTRACT

A projectile includes a mechanism which allows the fin position to be reversed after the projectile leaves the launch tube thus allowing the fins to have reversed leading edges, which avoids the costly weight of the one-piece design in the prior art, which is a parasitic weight that will result in a lower velocity, and consequently lower kinetic energy, from the same propellant charge. This mechanism also avoids having extra pieces falling from the muzzle and near the firing team or troops near the gun, and has the advantage of a simple, low-weight deployment mechanism which results in the least aerodynamic resistance after full deployment. The mechanism has at least one small winglet on each reversible fin which generates an aerodynamic lifting force to provide reversal of the fin after the projectile leaves the launch tube. These winglets are positioned and designed to cause the least increase in aerodynamic drag.

5 Claims, 9 Drawing Sheets

KINETIC ENERGY PROJECTILE WITH FIN LEADING EDGE PROTECTION MECHANISMS

This application is a division of application Ser. No. 08/716,678, filed Sep. 13, 1996 now U.S. Pat. No. 5,668,347.

GOVERNMENTAL INTEREST

The invention described herein may be manufactured, used and licensed by or for the United States Government without payment to me of any royalty thereon.

TECHNICAL FIELD

The present invention relates to projectiles and the protection of their exterior surfaces against damage. In particular, but not exclusively, it relates to fin stabilized, kinetic energy projectiles.

BACKGROUND ART

Fins have been used for some time in the ordnance field to stabilize kinetic energy (KE) projectiles in flight. After the projectile exits the gun tube, aerodynamic spin is induced by canted control surfaces on the fin blades. This spin is necessary to stabilize the projectile and reduce yaw. Reducing the total yaw is extremely important in order to maximize terminal ballistic performance on target. Stabilizing the projectile gives a repeatable ballistic trajectory with a tighter dispersion pattern on target and a higher probability of hitting a target at range. For fin stabilized projectiles, fin damage will destabilize aeroballistic flight and induce yaw.

The main damage to KE projectile fins often occurs inside the gun tube, due to fin impact with propellant granules inside the cartridge during projectile acceleration and the high propellant flash temperatures. Additional damage to the fins is possible due to fin aerodynamic heating outside the gun tube. Fin impact damage occurs at the leading edge of the fins, and creates an irregular fin leading edge shape such as a saw tooth-like ragged edge. This is particularly evident on aluminum fins. Steel fins, because they are inherently heavier, are usually made thinner to compensate for their increased weight, which also makes them susceptible to impact damage.

Although minor fin damage may not be detrimental to projectile accuracy, a significant leading edge damage, which is generally not symmetric for all fins, can cause side forces on the projectile, and can alter the intended steady state spin for projectiles with chamfered fin leading edge surfaces intended for producing spin.

Coating the fins with a thin, hard protective material only helps their heat resistance to burning and ablation during flight. Thin coating, however, does not greatly help protect against the direct impact damage due to propellant granules. The use of long, stick-type propellant may eliminate some impact damage, but is not desirable because it does not fill all the space around the projectile tail-end in its propellant case.

One prior art device to protect fins is shown in U.S. Pat. No. 5,062,585, which shows a fixed-in fin heat sink shield represented by a detached or attached additional fin piece to the original projectile fin. This added fin piece can help only in reducing the leading edge heating damage (during flight when out of the gun tube) but not the impact damage inflicted by the powder granules. Another prior art device is shown in U.S. Pat. No. 4,936,219, which shows a one-piece protection concept covering both the base and the whole fins of a projectile. U.S. Pat. No. 5,474,256, shows a glove-type fin cover made of combustible material to protect the fin and will be burned before exiting the gun muzzle.

STATEMENT OF THE INVENTION

It is therefore an object of the present invention to reduce fin leading edge damage suffered during gun tube launch, specifically the damage due to fin impact with the propellant granules.

A further object of the present invention is to maintain the static stability of the projectile through the preservation of fin lift capability by eliminating fin leading edge damage.

Another object is to preserve the intended steady state design spin value of the projectile which is produced, partially, by the chamfered leading edges of the fins.

Still other objects and advantages of the present invention will become readily apparent to those skilled in this art from the detailed description, wherein only the preferred embodiment of the present invention is shown and described, simply by way of illustration of the best mode contemplated of carrying out the present invention. As will be realized, the present invention is capable of other and different embodiments, and its several details are capable of modifications in various obvious respects, all without departing from the present invention. Accordingly, the drawings and descriptions are to be regarded as illustrative in nature, and not as restrictive.

These and other objects are achieved by providing two different mechanisms for projectile fin protection. The first mechanism allows the fin position to be reversed after the projectile leaves the launch tube thus allowing the fins to have reversed leading edges, which avoids the costly weight of the one-piece design in the prior art, which is a parasitic weight that will result in a lower velocity, and consequently lower kinetic energy, from the same propellant charge. The first mechanism also avoids having extra pieces falling from the muzzle and near the firing team or troops near the gun. Additionally, the first mechanism has the advantage of a simple, low-weight deployment mechanism which results in the least increase in aerodynamic resistance after full deployment. The first mechanism has at least one small winglet on each reversible fin which generates an aerodynamic lifting force to provide reversal of the fin after the projectile leaves the launch tube. The second mechanism has the advantage of being mechanically simpler than the first mechanism and also having no increase in the aerodynamic drag force of the projectile when the projectile leaves the gun tube. The fins have their leading edges protected by sliding shields which are ejected after the projectile exits the launch tube by a lifting surface positioned at an appropriate angle to the oncoming airflow to cause the shield to slide over the fins leading edge and away from the body of the projectile.

DETAILED DESCRIPTION OF THE PREFERRED EMBODIMENTS

Figure 1A:
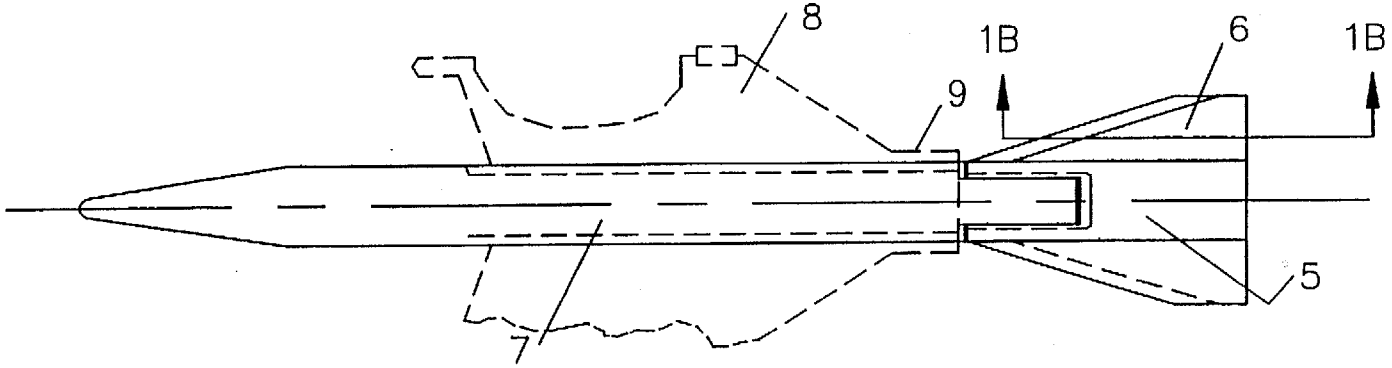
FIG. 1A PRIOR ART
FIG. 1A depicts the prior art technology of the fins of a typical multi-fin KE projectile prior to launch.
Figure 1B:
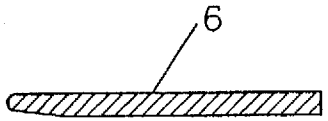
FIG. 1B is a cross section view along line 1B—1B.

Referring now in detail to the drawings wherein like parts are designated by like reference numerals throughout, there is illustrated in FIG. 1 a typical prior art projectile having a fin set 5 having multiple fins 6 screwed into the tail end of penetrator rod 7. A multi-piece sabot 8 is placed on rod 7 and rides on strong buttress grooves on rod 7 surface. The tail end 9 of sabot 8 is facing the front end off in set 5.

Figure 2:
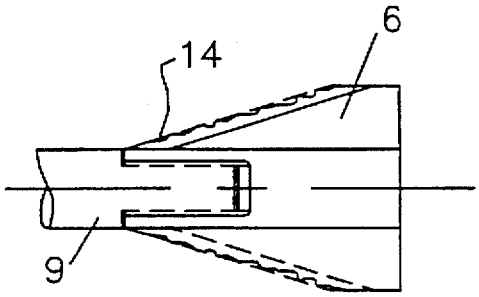
FIG. 2 PRIOR ART
FIG. 2 depicts the prior art technology of KE fins after launching.

As shown in FIG. 2, fin impact damage occurs at the leading edge 14 of fins 6, and creates an irregular fin leading edge shape. In some cases, a saw tooth-like ragged edge is created on some aluminum fins.

Figure 3A:
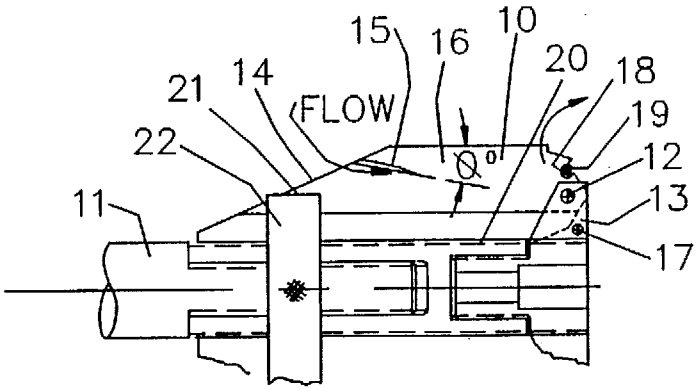
FIG. 3A depicts the first embodiment of the present invention prior to launching and deployment.
Figure 3C:
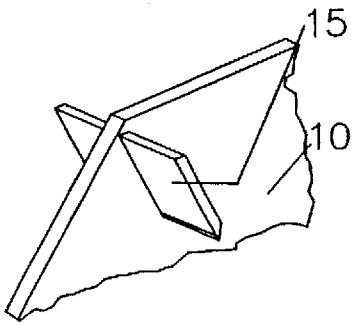
FIG. 3C is an isometric view of the winglets of the embodiment shown in FIG. 3A.
Figure 3B:
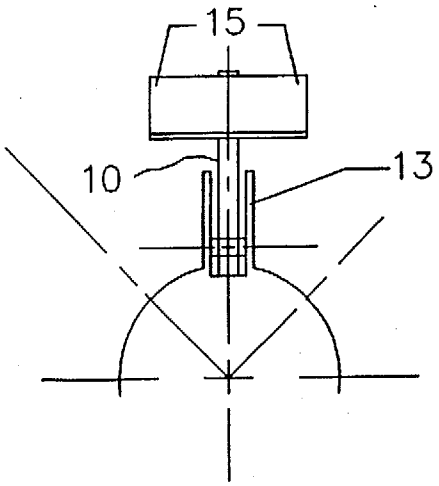
FIG. 3B is a side view of the embodiment shown in FIG. 3A.
Figure 4A:
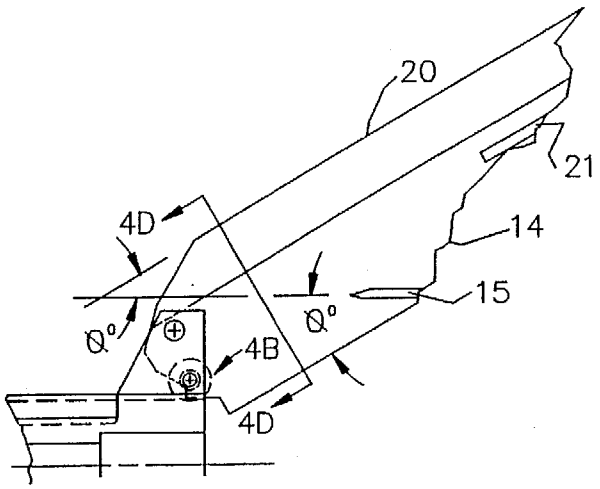
FIG. 4A depicts the first embodiment of the present invention after launching and fin deployment.
Figure 4B:
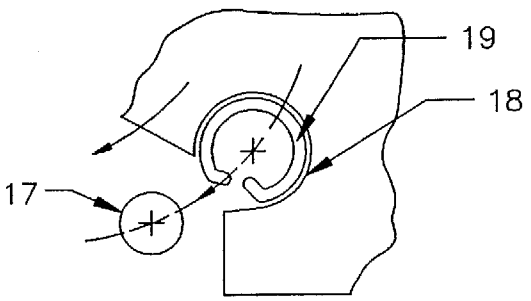
FIG. 4B is an enlargement of area 4B shown in FIG. 4A.
Figure 4D:
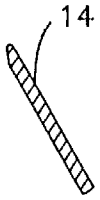
FIG. 4D is a cross section view along line 4D—4D.
Figure 4C:
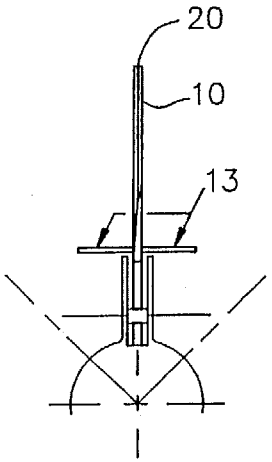
FIG. 4C is a side view of the embodiment shown in FIG. 4A.

A first embodiment of the present invention is shown in FIG. 3A. Reversible fin 10 is positioned along aft projectile body 11 and allowed to fold out and away from aft projectile body 11, pivoting around pin 12, which is housed in bracket sleeve piece 13, that may be screwed on to the tail end of aft projectile body 11. The leading edge 14 of reversible fin 10 faces the oncoming air and is impacted by the propellant granules during launch. As shown in FIG. 3B & 3C, a reversal initiating force is provided by small aerodynamic lifting surfaces 15, otherwise known as winglets, on each side of reversible fin 10. Winglets 15 are positioned at an angle 16 of $\phi$ degrees relative to aft body 11 axis (the direction of projectile movement inside the tube). The surface area and inclination angle $\phi$ of winglets 15 are designed such that they produce enough lifting force (once out of the gun tube bore) to cause reversible fin 10 to rotate clockwise (for this specific configuration) around pin 12. Reversible fin 10 has a rotation stopping and locking mechanism that holds new leading edge 20 of reversible fin 10 at an angle $\phi$ relative to projectile body 11 axis, shown in FIG. 4. FIG. 3 & 4C show a simple rotation stopping mechanism consisting of pin 17, a circular notch 18 in fin 10 surface, and a locking washer spring 19. The old bottom edge 20 of fin 10 will then be the new leading edge 20 of fin 10 after deployment, as shown in FIG. 4A & 4C. The locking mechanism shown is only one possible design. Other more sophisticated locking mechanisms can also be employed. When fully deployed, as shown in FIG. 4A, fin 10 new leading edge 20 will make an angle $\phi$ with aft body 11 axis. The reversal initiating winglets 15 will be at a zero degree angle with the oncoming air stream, thus causing the least possible aerodynamic drag.

Figure 5:
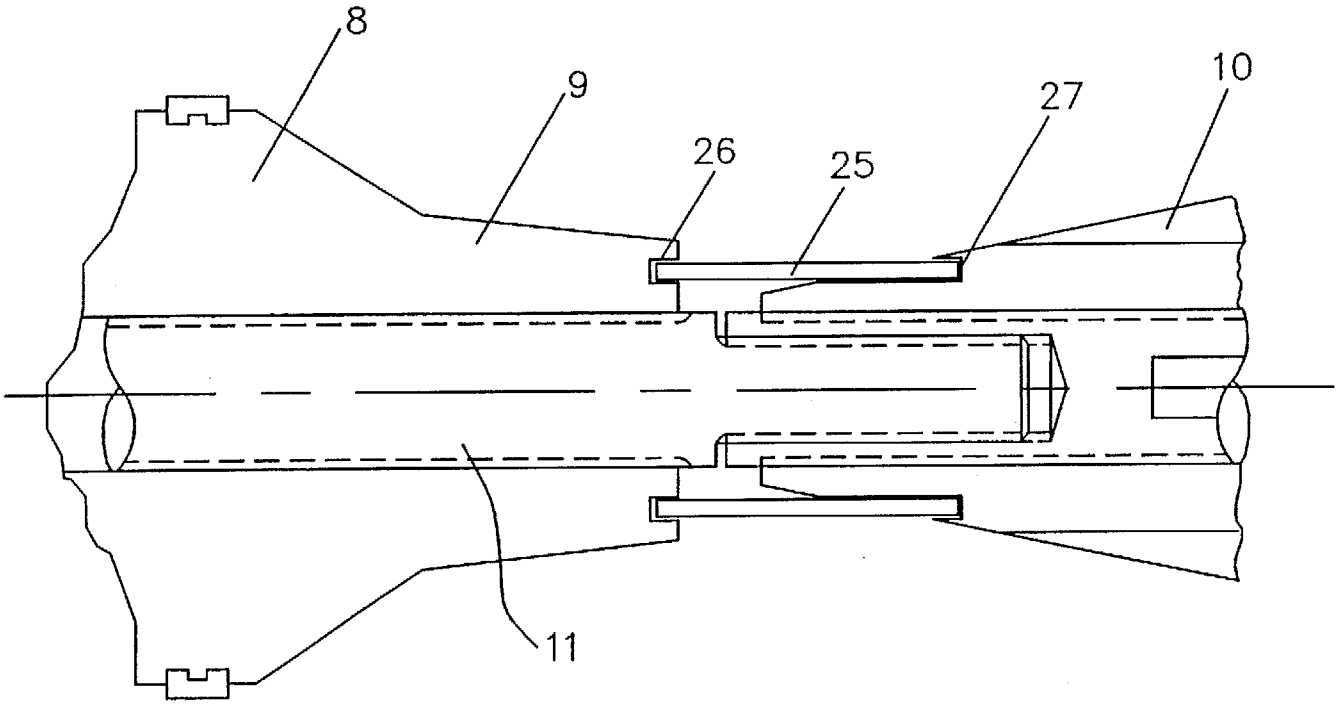
FIG. 5 depicts a second method for fin restraining during in-bore travel.
Figure 6A:
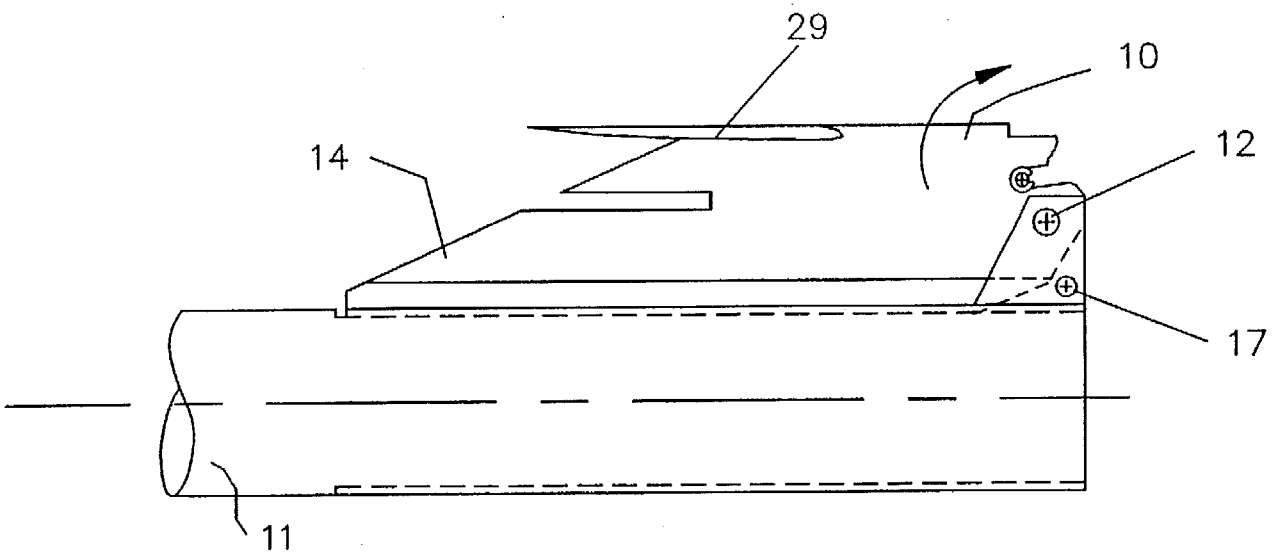
FIG. 6A shows the variation on the first embodiment fin design prior to launch.
Figure 6B:
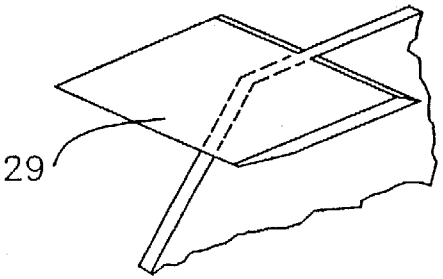
FIG. 6B is an isometric view of a portion of the embodiment of FIG. 6A.

The fins of the projectile may be restrained from movement during handling, storage and inside the tube bore by different methods. In FIG. 3A, the first method is represented by slot 21 in reversible fin 10 and a piece of strapping tape 22 consisting of thin, moderately strong material which may be combustible and thus consumed by the hot gases around the fins during launch. During in-bore travel, reversible fins 10 are surrounded by high pressure (40,000–60,000 psi) which necessitates the need for a relatively large force if fins 10 are to be moved. Therefore, the chances of the fins to rotate is very small since there exists no such huge force. A second restraining method is shown in FIG. 5 and consists of a multipiece spacer tube piece 25 of thin, non-combustible material (preferably from the same material that sabot 8 is made from). Spacer tube piece 25 is housed in a circular cavity 26 in the tail end 9 of sabot 8 and its other end is housed in slot 27 in fin 10. The spacer tube pieces 25 will be pushed away from the aft projectile body 11, thus freeing the fins, when the sabot 8 pieces get discarded by aerodynamic forces once projectile 7 leaves the gun tube.

Figure 7A:
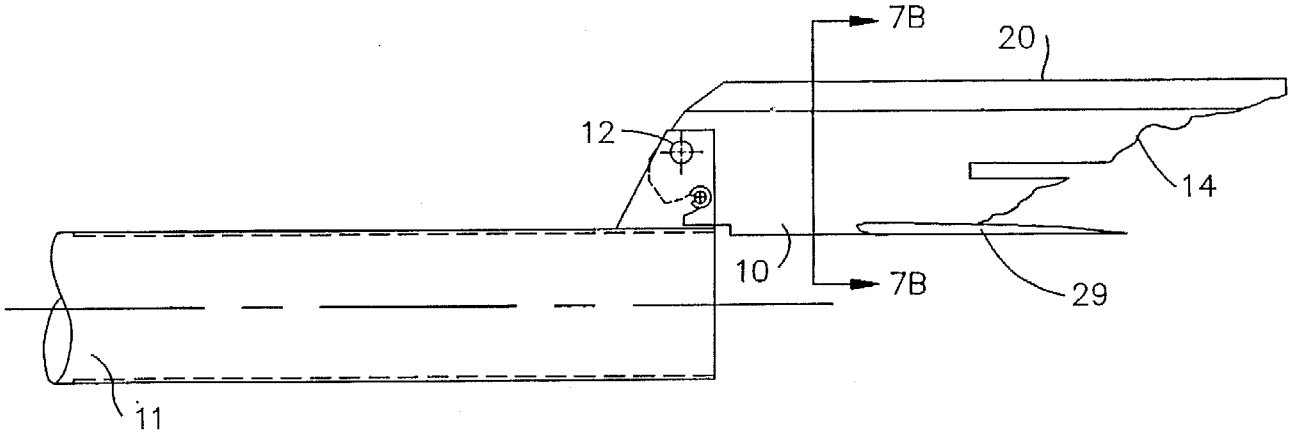
FIG. 7A shows the variation on the first embodiment fin design after launch.
Figure 7B:
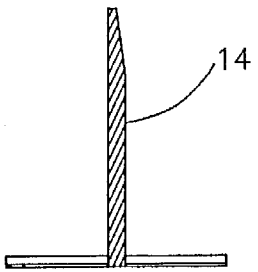
FIG. 7B is a cross section view along line 7B—7B.
Figure 8:
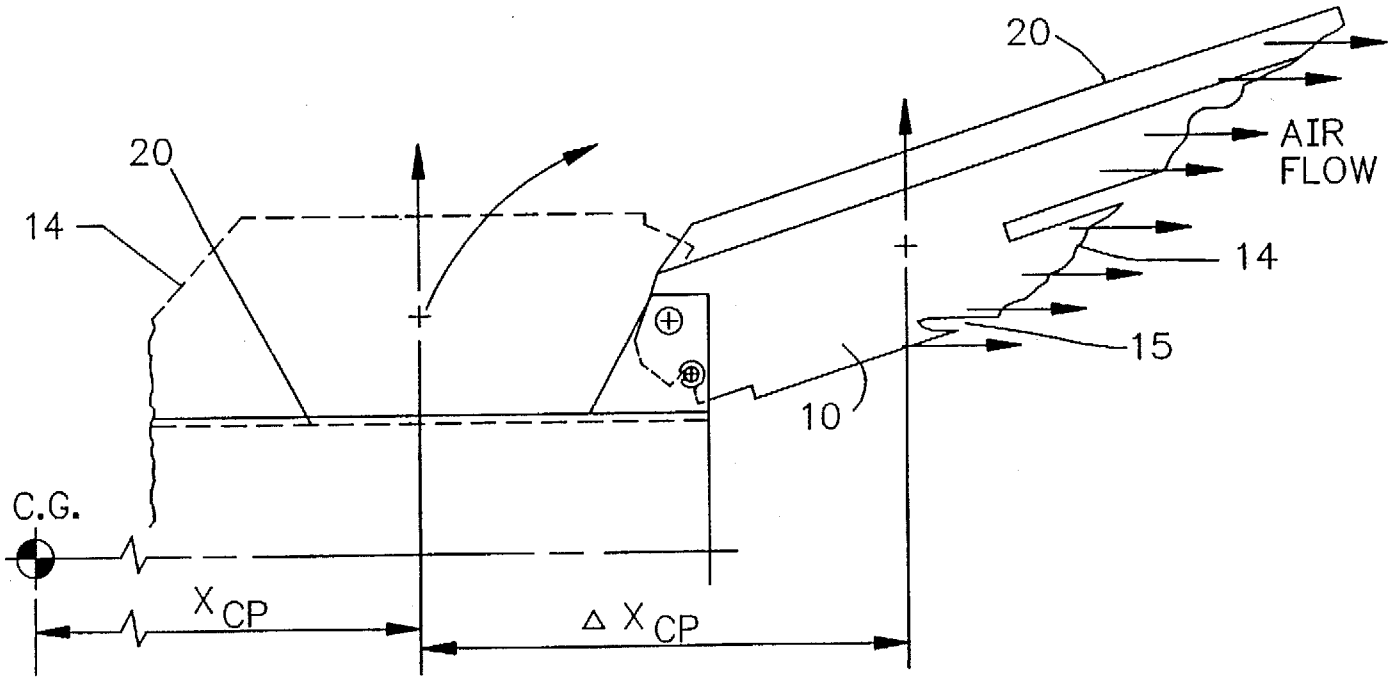
FIG. 8 shows the advantage of the new reversible leading edge concept of the present invention.
Figure 9A:
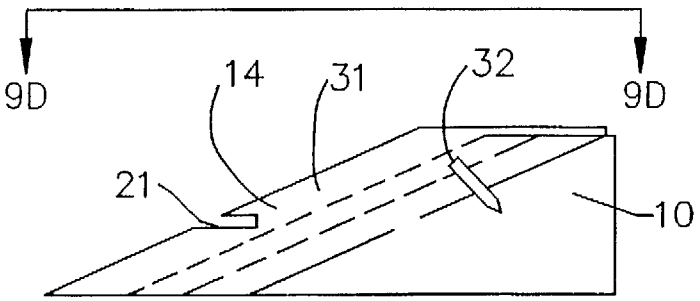
FIG. 9A depicts the second embodiment of the present invention.
Figure 9B:
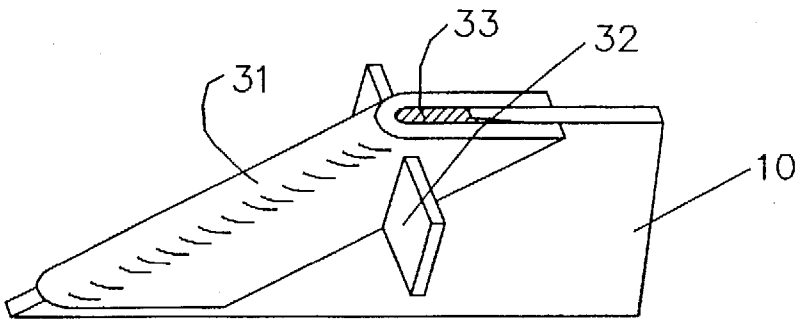
FIG. 9B is an isometric view of the embodiment of FIG. 9A.
Figure 9C:
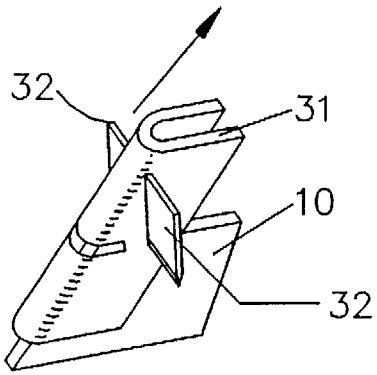
FIG. 9C is an isometric view of the embodiment of FIG. 9A during ejection.
Figure 9D:
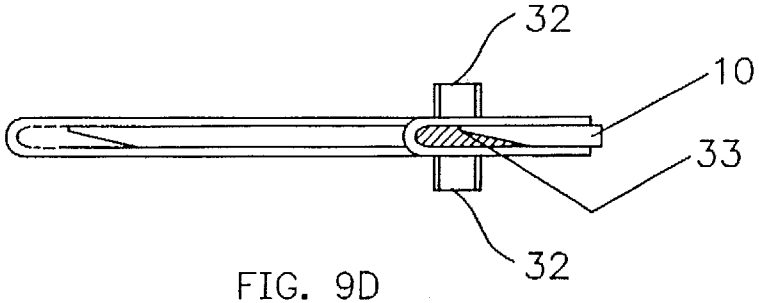
FIG. 9D is a top view of the embodiment of FIG. 9A.

A variation on the first embodiment leading edge protection mechanism is shown in FIG. 6A, 6B and FIG. 7A, 7B. The deployment rotation of fin 10 in this variation is a complete 180 degrees as shown in FIG. 7A. The reversal initiating surfaces are combined into a one piece winglet 29 at the tip chord of fin 10. The reversal initiating surfaces 29 are at zero degree angle with the oncoming air stream. The improvement in the aerodynamics of the projectile fin can be best understood by referring to FIG. 8. First, leading edge 14 has been damaged and reversed backward, as shown, such that the ragged edges will no longer strongly affect the fin 10 surface aerodynamics. When this occurs, less side force will be produced by the fins, and with less side force, the projectile becomes more accurate in hitting its intended target. Second, when the fins flip backwards, the center of pressure of the fins, which was at distance $X_{cp}$ from the center of gravity (CG) of projectile 7, moves rearward by distance $\Delta X_{cp}$ and farther away from the CG of projectile 7. This movement will directly increase the static stability margin of projectile 7, thus increasing the pitch damping moment of projectile 7 which decreases the pitching motion angle, which is a strongly desired performance feature.

Second Embodiment

A second embodiment fin leading edge damage protection mechanism is a self-ejecting leading edge shield piece as shown in FIGS. 9A–9D. A piece of relatively thin shield material 31 is bent around the leading edge 14 of fin 10 so as to allow the easy sliding of material 31 along edge 14. These shields have two movement-causing surfaces 32, one on each side of fin 10. A soft padding material piece 33 may be placed between leading edge 14 of fin 10 and shield piece 31 to prevent leading edge damage. When the projectile starts moving inside the shell cartridge, shield 31 will prevent damage to fin 10 due to the impact of the granules. When the projectile leaves the gun tube, movement-causing surfaces 32 are designed to generate enough lifting force to cause the sliding of shield piece 31 up and away from the projectile body. The original fins of the projectile will then not get damaged by the propellant granules.

It will be readily seen by one of ordinary skill in the art that the present invention fulfills all of the objects set forth above. After reading the foregoing specification, one of ordinary skill will be able to effect various changes, substitutions of equivalents and various other aspects of the present invention as broadly disclosed herein. It is therefore intended that the protection granted hereon be limited only by the definition contained in the appended claims and equivalents thereof.

Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

What is claimed is:

1. A device to protect the fins of a projectile comprising:

a moveable shield on the leading edge of said fin;

means to restrain movement of said shield;

means to eject said shield after said projectile exits from a gun tube after launch; and, further comprising padding material between said shield and said fin.

2. The device of claim 1 wherein said means to restrain movement comprises a band around said fins.

3. The device of claim 2 wherein said band is combustible.

4. The device of claim 1 wherein said means to eject said shield comprises an aerodynamic lifting surface.

5. The device of claim 4 wherein said aerodynamic lifting surface is a winglet.

* * * * *